US007111677B2

(12) United States Patent
St. Clair

(10) Patent No.: US 7,111,677 B2
(45) Date of Patent: Sep. 26, 2006

(54) SAND CONTROL FOR BLANKING PLUG AND METHOD OF USE

(75) Inventor: Guy St. Clair, Bedford (CA)

(73) Assignee: Baker Hughes Incorporated, Houston, TX (US)

( * ) Notice: Subject to any disclaimer, the term of this patent is extended or adjusted under 35 U.S.C. 154(b) by 342 days.

(21) Appl. No.: 10/819,663

(22) Filed: Apr. 7, 2004

(65) Prior Publication Data

US 2004/0206513 A1 Oct. 21, 2004

Related U.S. Application Data

(60) Provisional application No. 60/463,163, filed on Apr. 16, 2003.

(51) Int. Cl.
*E21B 33/12* (2006.01)

(52) U.S. Cl. ..... 166/135; 166/192; 166/386

(58) Field of Classification Search ..... 166/135, 166/192, 386, 323, 136, 382
See application file for complete search history.

(56) References Cited

U.S. PATENT DOCUMENTS

| | | | | |
|---|---|---|---|---|
| 64,549 A | | 5/1867 | McDonald | |
| 2,880,970 A | | 4/1959 | Swart | 255/303 |
| 2,970,648 A | | 2/1961 | Daffin et al. | |
| 3,581,819 A | | 6/1971 | Tamplen | 166/224 |
| 3,971,438 A | | 7/1976 | Crowe | 166/224 |
| 4,510,995 A | * | 4/1985 | Krause et al. | 166/382 |
| 4,632,193 A | | 12/1986 | Geczy | 175/65 |
| 4,760,879 A | * | 8/1988 | Pringle | 166/323 |
| 4,836,278 A | * | 6/1989 | Stone et al. | 166/136 |
| 4,984,631 A | | 1/1991 | Reesing | 166/115 |
| 5,342,520 A | | 8/1994 | Lyon | 210/251 |
| 5,542,475 A | * | 8/1996 | Turner et al. | 166/135 |
| 2001/0042617 A1 | | 11/2001 | Beck et al. | 166/65.1 |

* cited by examiner

*Primary Examiner*—David Bagnell
*Assistant Examiner*—Matthew J. Smith
(74) *Attorney, Agent, or Firm*—Madan, Mossman & Sriram P.C.

(57) ABSTRACT

A blanking plug device, system and method of use, wherein the plug device has an anchoring portion for securing the blanking plug device within a tubing string or other well conduit. In preferred embodiments, the anchoring portion comprises a locking device such as the Extreme SUR-SET® locking system. However, other anchoring mechanisms may be utilized as well. The blanking plug device has a lower plug portion that incorporates a screening section. The screening section permits flow of fluid through the sidewall of the plug portion while substantially preventing the passage of solid particles.

14 Claims, 2 Drawing Sheets

SAND CONTROL FOR BLANKING PLUG AND METHOD OF USE

The present application claims the priority of U.S. Provisional patent application Ser. No. 60/463,163 filed Apr. 16, 2003.

BACKGROUND OF THE INVENTION

1. Field of the Invention

The invention relates generally to downhole locking devices and blanking plugs. In specific aspects, the invention relates to devices and methods for sand control in association with these devices.

2. Description of the Related Art

Locking devices, or locks, are used to anchor a well tool at a particular location within a well conduit, such as a tubing string. A locking device is described in U.S. Pat. No. 4,510,995 entitled "Downhole Locking Apparatus" which was issued to Krause, Jr. et al. and is owned by the assignee of the present application. That patent is incorporated herein by reference. A locking device of this type is also available commercially as the Extreme SUR-SET® locking system sold by Baker Oil Tools, 6023 Navigation Blvd., Houston, Tex. 77253. This locking device has a set of radially expandable locking dogs that seat within a complimentary nipple or profile in the tubing string. The lock also incorporates a no-go shoulder to help ensure proper positioning in the tubing string. The lock is run into the tubing string using a running tool, which also sets the lock by expanding the locking dogs into the matching nipple. The running tool is then removed. When it is desired to remove the lock, a retrieval tool is run into the tubing string, engages the lock and retracts the locking dogs. The retrieval tool and lock may then be removed from the wellbore.

Safety valves and check valves are typically anchored with a lock. Alternatively, a lock may serve as a blanking plug to establish a fluid seal within the tubing string. One example is the Extreme SUR-SET® Model H blanking plug available from Baker Oil Tools, 6023 Navigation Blvd., Houston, Tex. 77253. When in place, the blanking plug blanks off all pressure from above or below the lock. Blanking plugs are useful for pressure testing the tubing string or to abandon certain zones within a well.

Certain blanking plugs use a removable prong that is inserted into the plug to equalize the pressure across the plug and to complete the fluid seal. A pressure equalization port is disposed through the housing of the plug. After setting the plug portion and prior to installation of the prong, fluid containing sand or other solid particles may enter this port and cause clogging of the interior. As a result, it may be difficult to insert or secure the prong within the plug portion. The present invention addresses the problems of the prior art.

SUMMARY OF THE INVENTION

The invention provides an improved blanking plug device having an anchoring portion for securing the blanking plug device within a tubing string or other well conduit. In preferred embodiments, the anchoring portion comprises a locking device such as the Extreme SUR-SET® locking system. However, other anchoring mechanisms may be utilized as well. The blanking plug device has a lower plug portion that incorporates a screening section. The screening section permits flow of fluid through the sidewall of the plug portion while substantially preventing the passage of solid particles.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
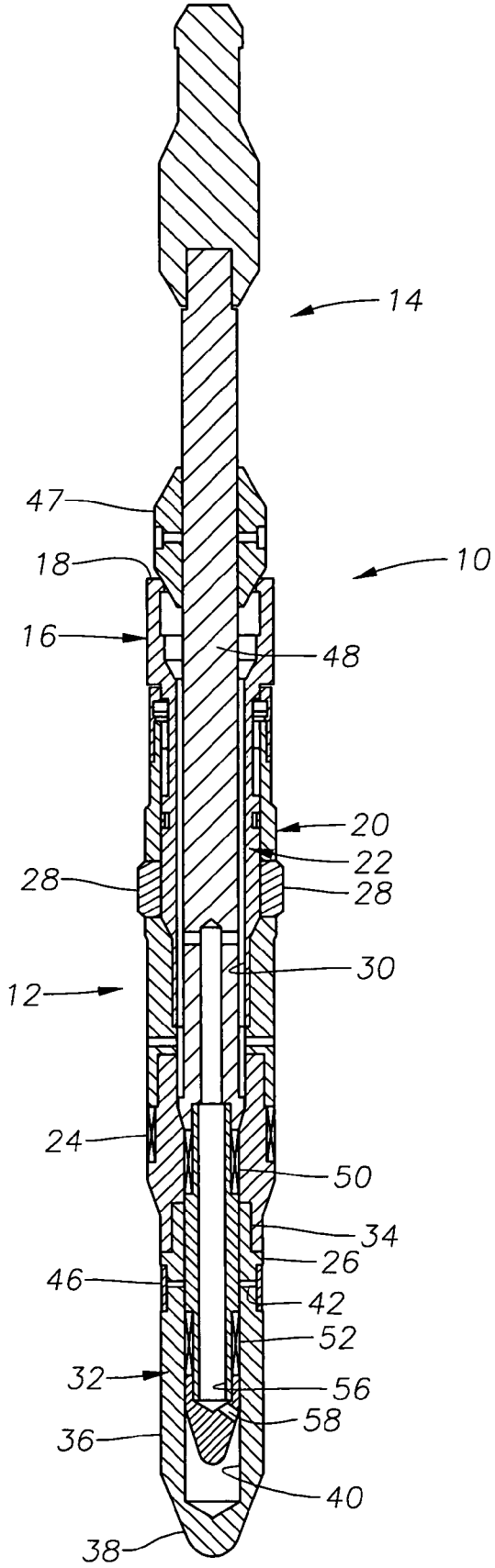
FIG. 1 is a side, cross-sectional view of an exemplary locking device configured for use as a blanking plug.

FIG. 1 depicts an exemplary blanking plug device 10 that has been constructed in accordance with the present invention. The blanking plug device 10 is adapted to be run into a production tubing string (not shown) or other well conduit on slickline or wireline. As such operations are well known in the art, they are not described in any detail here. The blanking plug device 10 depicted has two separate components: a plug 12 and a blanking member, specifically prong, 14, which is shown removably disposed within the plug 10. In operation, the plug 12 is run into the tubing string first and then the prong 14 is run into the tubing string and seated inside the plug 12. The plug 12 has an upper anchoring lock portion 16, the upper end of which is shown at 18. In preferred embodiments, the lock portion 16 is a locking device of the type described in U.S. Pat. No. 4,510,995. Preferably, the lock portion 16 comprises an Extreme SUR-SET® locking system. Because the structure and operation of this type of lock portion 16 is well known, it will only be described briefly herein. While in preferred embodiments of the present invention the lock portion 16 is a locking mechanism of the type described in U.S. Pat. No. 4,510,995 or an Extreme SUR-SET® locking system, the invention is not, in fact, limited only to these devices. Rather, the invention has application as well for other types of anchoring mechanisms, including those that, for example, do not require a complimentary profile or nipple within the tubing string and those that might anchor within a tubing string using slips, packers, or other means known in the art for securing a tool within a conduit.

The exemplary lock portion 16 includes a generally cylindrical outer housing 20 and an inner mandrel 22 that is axially moveable with respect to the outer housing in order to accomplish setting and unsetting of the lock portion 16 within a section of tubing. The outer housing 20 features a set of annular seals 24 above its lower end 26. A plurality of radially expandable locking dogs 28 are spaced about the circumference of the lock portion 16 and are shaped and sized to selectively reside within a complimentary nipple or profile (not shown) within a tubing string section. The inner mandrel 22 of the lock portion 16 defines a central axial bore 30.

Figure 2:
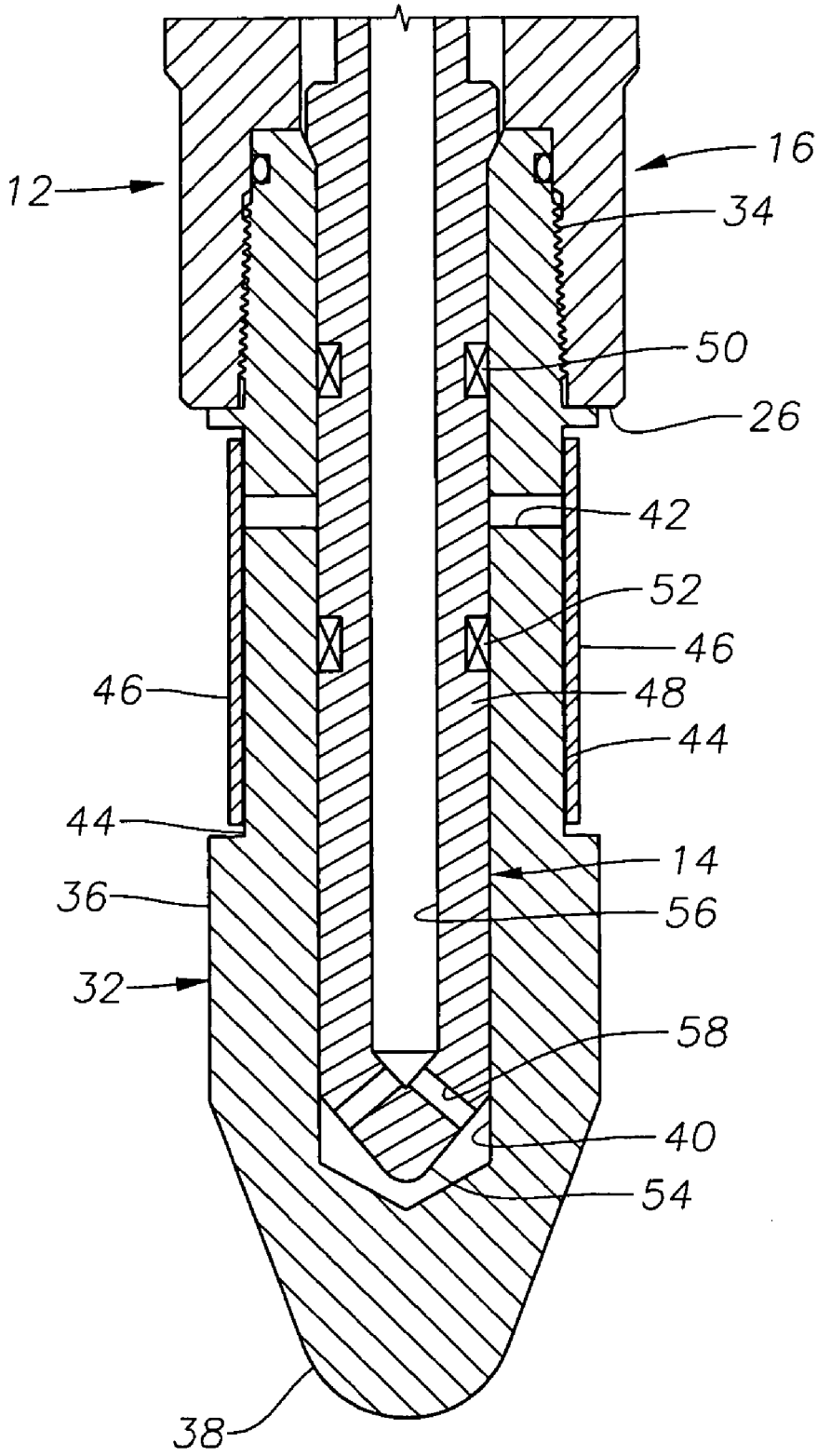
FIG. 2 is an enlarged view of a lower portion of the blanking plug shown in FIG. 1.

A plug section 32 is secured to the lower end 26 of the outer housing 20 via threaded connection 34. FIG. 2 provides an enlarged view of the plug section 32. The plug section 32 is a tubular body 36 that terminates in a rounded nose cone 38. An axial blind bore 40 is defined within the body 36 and, when the plug section 32 is secured to the outer housing 20, the blind bore 40 is aligned with the central axial bore 30. One or more pressure equalization ports 42 (one shown) are disposed radially through the tubular body 36. As FIG. 2 depicts, the outer radial surface of the tubular body 36 has a radially reduced portion, or groove, 44. The equalization port(s) 42 is (are) disposed through the body 36 within this groove 44. A screen 46 surrounds the tubular body 36, residing within the groove 44. The screen 44 provides a mesh for screening out of sand and other solid particles and prevents their entry into the equalization port(s) 42. While screen 44 preferably comprises a sand screen, of a type known in the art, other suitable filtering media may be used as well. Further, while the screen 44 is shown as being located radially outside of the body 36, it might as easily be located at any point within the port 42 or even at the radially interior end of the port 42.

The prong 14 includes an upper enlarged portion 47 and a reduced diameter prong portion 48. The prong portion 48 is shaped and sized to reside within the axial bore 30 and blind bore 40 when the prong 14 is inserted axially into the plug 12. The enlarged portion 47 will be seated atop the upper end 18 of the plug 12 when the prong 14 is fully inserted. The prong portion 48 carries a pair of annular fluid seals 50, 52 proximate its lower end 54. When the prong 14 is fully inserted into the plug 12, the enlarged portion 47 of the prong 14 seats against the upper end 18 to provide a no-go shoulder stop that prevents further downward movement of the prong 14 within the plug 12. At this point, the seals 50, 52 are positioned on either side of the equalization port(s) 42 of the plug section 32. It is also noted that the prong portion 48 defines a central axial fluid bore 56 and that a pressure port 58 is disposed proximate the lower end of the prong portion 48 to enable fluid communication between the exterior of the prong portion 48 and the bore 56.

In operation, the plug 12 is run into a tubing string by a running tool (not shown), and the running tool is used to radially expand the locking dogs 28 into a mating profile or nipple in the tubing string in a manner that is known in the art. The running tool is withdrawn from the tubing string. At this point, fluid within the tubing string is capable of entering the axial bore 30 and blind bore 40 via the equalization port(s) 42. The screen 46 prevents sand and other solids from entering the equalization port 42.

The prong 14 is then run into the tubing string on a separate running tool (not shown) and inserted into the plug 12, again in a manner well known in the art. As the prong portion 48 enters the axial bore 30, fluid within the axial bore 30 and blind bore 40 will enter the pressure port 58 and the axial bore 56 of the prong 14, thereby equalizing pressure across the plug 12. As the prong 14 becomes fully seated within the plug 12, the annular seal 52 will move below the equalization port 42, thereby preventing further transmission of fluid from the equalization port 42 into the pressure port 58. The prong 14 is then locked into the plug 12, in a manner known in the art, to blank off pressure across the blanking plug device 10.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A blanking plug device comprising:

a plug having an anchoring lock portion for selectively anchoring the plug device within a section of tubing string and a plug portion defining a blind bore within and having a pressure equalization port for transmission of fluid from the exterior of the plug portion to the blind bore; and a screen associated with the pressure equalization port to substantially prevent transmission of solids through the equalization port.

2. The blanking plug device of claim 1 further comprising a blanking member that is selectively disposable within the blind bore of the plug to blank off pressure across the plug.

3. The blanking plug device of claim 1 wherein the blanking member comprises a prong.

4. The blanking plug device of claim 1 wherein the anchoring lock portion comprises at least one locking dog that is selectively radially expandable into a mating profile in a wellbore wall.

5. The blanking plug device of claim 3 wherein the prong carries a pair of annular fluid seals which, when the prong is inserted into the blind bore, are positioned on either side of the pressure equalization port.

6. The blanking plug device of claim 2 wherein the plug further comprises an upper end and the blanking member further comprises an enlarged portion to abut and engage the upper end to provide a no-go shoulder arrangement.

7. The blanking plug device of claim 1 wherein the plug has a plug portion having a substantially tubular body, and the screen encircles a portion of the tubular body in a circumferential manner.

8. A system for selectively blanking off pressure within a section of wellbore, comprising:

a) a plug having an anchoring lock portion for selectively anchoring the plug device within a section of tubing string and a plug portion defining a blind bore within and having a pressure equalization port for transmission of fluid from the exterior of the plug portion to the blind bore, and a screen associated with the pressure equalization port to substantially prevent transmission of solids through the equalization port; and b) a removable blanking member that is disposable within the blind bore to blank off pressure across the plug.

9. The system of claim 8 wherein the plug has a plug portion having a substantially tubular body, and the screen encircles a portion of the tubular body in a circumferential manner.

10. The system of claim 8 wherein the anchoring lock portion of the plug further comprises a plurality of locking dogs being shaped and sized to reside within a matching profile in the surrounding tubing string section, the locking dogs being outwardly radially expandable into engagement therewith.

11. The system of claim 8 wherein the blanking member carries a pair of annular fluid seals which, when the blanking member is inserted into the blind bore, are positioned on either side of the pressure equalization port.

12. A method of blanking off pressure within a section of wellbore comprising:

securing a plug within a section of a wellbore, the plug having a plug portion defining a blind bore within and having a pressure equalization port for transmission of fluid from the exterior of the plug portion to the blind bore;

filtering fluid transmitted toward the blind bore through the pressure equalization port by passing the fluid through a screen; and disposing a blanking prong member within the blind bore of the plug to create a fluid seal across the plug.

13. The method of claim 12 wherein the step of securing the plug within a section of a wellbore comprises selectively expanding a set of locking dogs radially outwardly from said plug.

14. The method of claim 12 wherein the step of disposing a blanking prong member within the blind bore of the plug further comprises disposing a pair of annular fluid seals into the blind bore.

* * * * *